United States Patent [19]

Balogh et al.

[11] 4,039,753

[45] Aug. 2, 1977

[54] SINGING SUPPRESSOR DEVICE

[75] Inventors: Geza Balogh, Budapest; Emil Sesztak, Maglod; Karoly Szabados, Budapest, all of Hungary

[73] Assignee: Elektroakusztikai Gyar, Budapest, Hungary

[21] Appl. No.: 573,989

[22] Filed: May 2, 1975

[30] Foreign Application Priority Data

June 5, 1974 Hungary ..... EE 2241/74

[51] Int. Cl.[2] ..... H04R 3/04

[52] U.S. Cl. ..... 179/1 FS

[58] Field of Search ..... 179/1 FS, 1 J, 107.2

[56] References Cited

U.S. PATENT DOCUMENTS

| | | | |
|---|---|---|---|
| 3,154,644 | 10/1964 | Tak | 179/1 J |
| 3,257,510 | 6/1966 | Burkhard | 179/1 FS |
| 3,429,999 | 2/1969 | Stover | 179/1 FS |
| 3,749,837 | 7/1973 | Doughty | 179/1 J |
| 3,842,204 | 10/1974 | Leslie | 179/1 J |

*Primary Examiner*—Kathleen H. Claffy
*Assistant Examiner*—E. S. Kemeny

[57] ABSTRACT

Singing suppressor device for preventing singing or self-oscillation caused by acoustic feedback arising in an audio-frequency signal transmitting electroacoustic chain comprising a sound sensing device (microphone), an amplifier and a sound generator. The invention relies on the variation in the temporal order of the delay time of an electrical delay unit, on an analog and/or digital principle, inserted into the electroacoustic chain. The variation of the delay time is performed by a control generator which, with the aid of an appropriate circuit (e.g. a modulator or an auxiliary generator) continuously changes the delay time as a function of time. This ensures that singing arises only at a considerably higher sound pressure level, because owing to the varying delay time appropriate amplitude, frequency and phase conditions to induce feedback are met for a short time or moment only.

8 Claims, 4 Drawing Figures

SINGING SUPPRESSOR DEVICE

The present invention relates to a singing suppressor which prevents singing from arising owing to acoustic feedback.

As is known it is of frequent occurrence that a signal coming from the output of an electroacoustic chain, built of active amplifying elements, returns to the input and that the system, when the phase and amplitude conditions are appropriate, is apt to cause the system to oscillate. At sound amplification, indoor or outdoor, it is of importance tht singing should start only at a high gain, i.e. at the achievable largest sound pressure level.

For the prevention of acoustic self-oscillation or singing the methods or devices including amplifiers or amplifier chains built up exclusively of electric and electronic elements are not suited (so also the neutralization or the use of frequency correctors).

This is the reason why for a long time already efforts have been made to achieve free-of-singing or free-of-self-oscillation amplification by the appropriate placing of loudspeaker microphones, the construction of halls or rooms of an appropriate architecture, and the achievement of a possibly high sound-pressure level.

The most critical link in singing owing to acoustic feedback is a back-coupling "element", i.e. the hall or room itself. On the assumption of general singing, as it occurs in practice, the temporal and spatial distribution of the sound energy in a hall cannot be assessed with the required accuracy with usual methods of acoustics. The dissociation of the sound-space formed in a hall into a direct sound-space and diffuse sound-space does not obey actual conditions. According to relevant literature (1), (2), statistical studies and measurements of the acoustic characteristics of halls have led to the conclusion that the sound pressure formed at a point of the hall presents a periodicity which may be expressed as the function of the frequency. The bibliographic references are 1. M. Schroeder: Die statistischen Parameter der Frequenzkurven von grossen Raeumen. *Acoustica,* Akustische Beihefte 1954, Heft 2, pp. 594 to 600;

2. W. K. Connor: Experimental Investigation of Sound-System-Room Feedback, *J. Audio Eng'g Soc. No.* 1 (1973), pp. 27 to 32. The highest sound pressure level, namely the level which determines the generation of singing, differs in halls of conventional architecture from the average sound pressure by about 10 to 12 decibels. The rate of the difference is a function of the characteristics of the hall, its volume, and the time of reverberation.

In large halls of conventional architecture the periodicity of the distribution of the sound pressure vs the frequency varies from theoretical considerations by of a value of 7/T Hz, where T denotes the mean time of reverberation of the hall. It was on this understanding that singing suppressors relying on frequency shift have been developed (3). The just mentioned reference is:

3. H. Bode & Moog: A High-Accuracy Frequency Shifter for Professional Audio Applications. *J. Audio Eng'g Soc.* No. 6 (1972) pp. 453 to 458. Their common feature is the insertion of a frequency shift circuit into the amplifier chain, which changes the frequency of all components of the signal passing the chain by a constant frequency value. In conformity with the results of the theoretical studies a value of 5 Hz has been chosen for the frequency shift. On the ground of theoretical calculations a value of 10 to 12 decibels may be achieved for the increase of the sound pressure level.

In practice, however, the value of the increase of the sound pressure level is lower by about 3 to 4 dB. In the methods so far known frequency shift is brough about by dual single-sideband modulation or an artifical circuit incorporating a phase-shift circuit. A common drawback of these arrangements is that, dependent on the method of modulation, non-linear distortions are apt to arise, which may be transposed also in the audible basic band. At the same time the apparatus are of extreme complexity and they are tolerance sensitive. At the same time the original sound picture appears in a distorted form, and owing to the constant frequency shift original musical consonances are apt to degenerate to dissonances.

The purpose of the present invention is to provide a device which, beside being of simple construction, effectively suppresses singing owing to acoustic feedback and considerably increases the value of the achievable gain and sound pressure without the risk of harmful distortions.

The device according tc the invention relies on the new recognition that, in addition to given frequency and phase conditions, a given time interval is also needed for the generation of singing or self-oscillation. In the following this interval will be referred to as "time interval of singing".

For an electroacoustic sound chain the time interval of singing is in general of the order of milliseconds. If the signal of the frequency and amplitude associated with the singing or self-oscillation appears at the input of the electroacoustic chain and is changed within the time interval of singing, the self-oscillation of the system will fail to come about or will appear only at a much higher amplitude level. If the characteristics of the electroacoustic chain are changed in a way that the chain remains in a condition for singing or self-oscillation for a time shorter than the time interval of self-oscillation, the singing or self-oscillation can be entirely prevented. This can be achieved by inserting a variable delay in the electroacoustic chain.

The present invention relates to a singing suppressor device which prevents singing or self-oscillation due to acoustic feedback from arising in an electroacoustic chain incorporating a sound sensing device, an amplifier and a sound transmitter, and which comprises at least one analogue and/or digital delay unit consisting of electrical and electronic elements and having at least one audio frequency input and output, at least one delay period determining control input, and of a delay period dependent on the frequency and/or amplitude of the electrical signal led to the input of the control input.

The control input of the delay unit(s) has at least one control generator coupled thereto, directly or at least through a frequency and/or amplitude modulator, for generating an electrical signal varing in time, of the modulator(s) at least one auxiliary generator being coupled to the other input.

Preferably a control generator is used, for generating a periodical electrical signal of a basic frequency less than 20 Hz, or of a frequency lower than the lower limit of the transmitting band of the electroacoustic chain. Preferably a control generator is used that generates a saw-tooth shaped electrical signal, and an electronic generating a saw shaped electrical signal should be interrupter or gain reducing circuit in inserted into the electroacoustic chain in a way that, during the flayback period of the sawtooth signal, this circuit interrupts the path of the audio frequency signal or reduces the gain of the electroacoustic chain.

A variant can also be used where a generator is used as the control generator which generates an electrical signal of components of a frequency varying in time, with a random variation, and of less than 20 Hz or less than the frequency of the lower limit of the transmitting band of the electroacoustic chain applied.

Furthermore it is recommended that a signal converter is used for the control or the auxiliary generator, transforming the audio frequency signal transmitted by the electroacoustic chain. The temporal shape, value and frequency of the electrical signal of the control and the auxiliary generator is preferably adjusted by means of a control element.

The advantage of the arrangement according to the invention lies in the fact that, by means of relatively simple devices, effective singing suppresion is achieved. At the same time the device is so designed to be adjustable by means of control features to different acoustic conditions of halls, spaces, sports establishments, or a TV or radio quiz programme. Thus it guarantees an optimum increase of the sound pressure level everywhere, unlike earlier arrangements which cannot be adjusted by means of control appliances.

Adjustability is of utmost importance because, according to the results of a study of the statistical characteristics of the sound space, as has already been made clear, the increase of loudness depends on the reverberation time of the hall and on the bandwidth of the electroacoustic chain being used.

Therefore it is justified to use a singing suppressor device according to the invention, whose characteristics (e.g. the amount and course of the delay time in the temporal order, the frequency, etc.) are variable in a relatively simple manner. With due regard to the acoustic characteristics of the hall, maximum increase of the sound pressure can be guaranteed.

The singing suppressor device according to the invention has yet other advantageous properties such as the transmission of the originally consonant sound picture in an unchanged (consonant) form, and no non-linear distortions will arise either. The equipment according to the invention is of moderate dimensions and of low weight, it may easily be made portable. Since it contains exclusively electrical and electronic devices or elements, its useful life and operational safety are extremely high.

The invention will in the following be described in all its details on hand of its embodiments, with reference to the accompanying drawings, wherein.

FIG. 1 presents an exemplary embodiment of an amplifying electroacoustic chain in which the inventive singing suppressor device is used;

Figure 1:
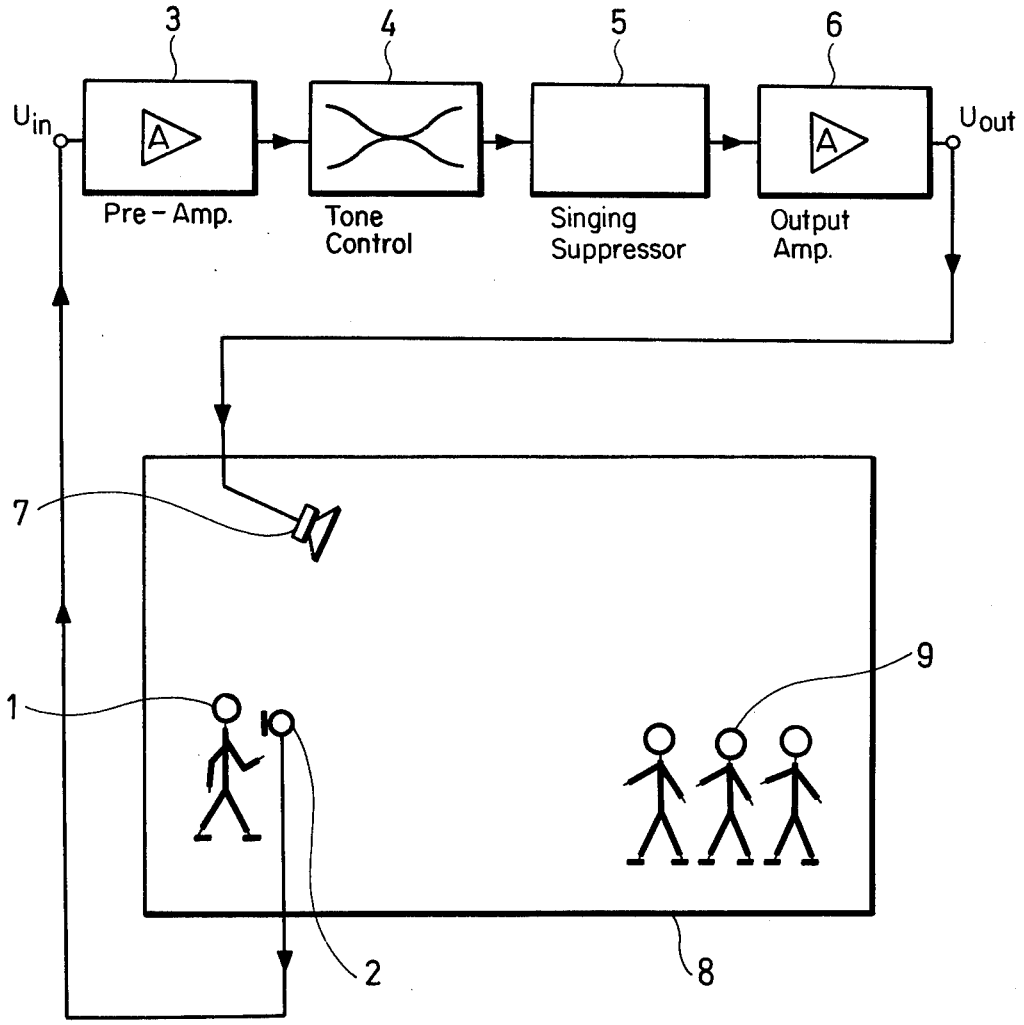

In FIG. 1 an electroacoustic chain is shown as it is used for amplification. A hall or space 8 is to be served by loudspeakers or sound radiators 7 with an appropriate sound pressure. In the hall or space 8 an audience 9 is seated wishing to listen to the voice of a speaker or a singer 1, properly amplified or at an appropriate sound pressure level. The voice of the speaker or singer 1 is sensed by a microphone 2 and this microphone transforms it into an electrical signal. The electrical signal of microphone 2 is an audio-frequency signal, amplified by a pre-amplifier 3. A tone control unit or sound corrector 4 has as its function to correct the defects and irregularities of the frequency response (here including the properties of the hall) of the whole transmission chain, and also to satisfy the individual taste of the audience. The inventive singing suppressor device is identified by numeral 5, of which exemplary embodiments are given in FIGS. 2 and 4. The output amplifier stage 6 guarantees a sufficiently high electrical output for the sound radiator(s).

As is known, electro-acoustic chains have a given transmitting band beyond whose lower and upper frequency limits the chain will not operate at all, or only at a considerably reduced rate. It is also known that at a given gain value this system will almost without exception, start singing within the transmitting hand owing to acoustic feedback, and become useless for normal amplification and listening. The cause of this is that the sound pressure generated by the loudspeaker(s) 7 generates an electrical signal in the microphone 2, which for a given gain then becomes self-supporting.

The function of the inventive singing suppressor 5 is to guarantee the adjustability of the gain to a higher value and prevent singing from arising. The same situation exists when the hall 8 is the site of a TV or radio quiz programme transmission. In this case the audio-frequency chain also incorporates a high-frequency transmitter and receiver unit, whereas the loudspeaker or sound radiator 7 enables the monitoring of or listening in to the programme.

Figure 2:
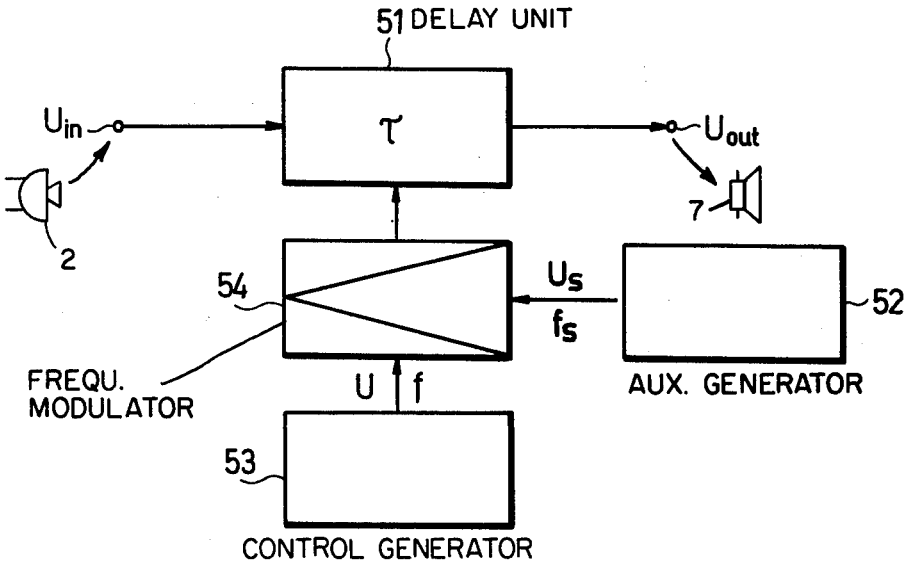
FIG. 2 is a schematic block diagram of the device according to the invention.

In FIG. 2 the block diagram of the singing suppressor according to the invention is shown by way an example.

Figure 3:
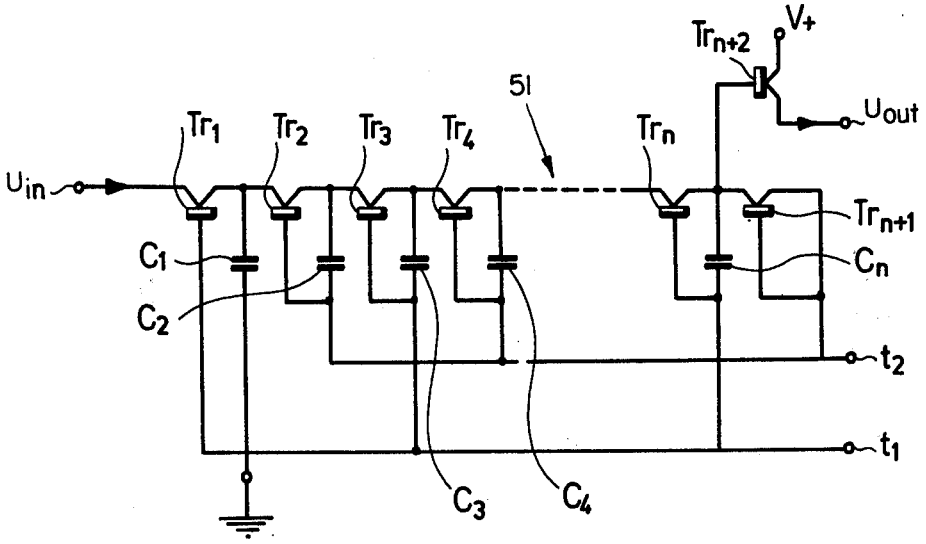
FIG. 3 is a circuit diagram of a delay unit used in one embodiment of the inventive device.

A delay unit 51 is used in the circuit, preferably for analog design arrangement. This unit is presented in detail in FIG. 3. The delay time of the delay unit is defined by the frequency $f_s$ of the electrical signal applied to the input of the control unit at $U_{in}$. The signal of a voltage $U_s$ and a frequency $f_s$ is generated by an auxiliary generator 52. The voltage $U_s$ preferably frequency modulated by means of a frequency modulator 54 with an electrical signal of a voltage $U_v$ and a frequency $f_v$ provided by a control generator 53.

This ensures that the voltage $U_{in}$ applied to the audio-frequency input of the delay unit 51 and the voltage $U_{out}$ appearing at the output of this unit, varying with the frequency $f_v$, are of different frequencies. If the voltage $U_{out}$ returns to the output, as indicated by practice, owing to the phase or frequency value changing with the frequency $f_v$, the conditions of singing are met only at high gains.

Obviously the delay time and its change have to be selected in a way that the ear should not perceive the change so brought about in the audio-frequency signal (4). This reference is 4. E. Zwicker et al.; Das Ohr als Nachrichtenempfaenger. S. Hirzel Verlag, Stuttgart, 1967. This is ensured by selecting for the control generator 53 a frequency lower than 20 Hz, or one lower than the lower cut-off frequency of the transmitting band.

In the exemplary embodiment of the invention shown in FIG. 2, a known bucket brigade device (BBD) operating on the analogue principle is used as a delay unit. The operation of this device is known and may be followed in FIG. 3: a chain is built up in series of the MOSFET transistors Tr . . . $Tr_n$ and the integrated condensers or capacitors $C_1$, $C_2$. . . $C_n$ in a way that the control electrodes of the transistors $Tr_1$, $Tr_3$, $Tr_5$ . . . $Tr_n$ (i.e. the odd transistors) are led out separately, commoned to a control input $t_1$, and so are the even transistors $Tr_2$, $Tr_4$, $Tr_6$ . . . $Tr_{n-1}$ to a terminal $t_2$ as an input. To each of the two junction points as control inputs a square signal is applied, phase shifted with respect to each other by 180°. In this case e.g. the odd transistors will be completely open, the even transistors completely blocked. The signal advancing to the input will be charged during the half-period of the square signal into condenser $C_1$ through the open transistor $Tr_1$. It cannot, however, proceed any further because at the same time transistor $Tr_2$ will be blocked. During the other half period of the square signal, transistor $Tr_1$ will open, the charge in condenser $C_1$ will be discharged into condenser $C_2$. This process follows the whole chain at a time of propagation jointly determined by the number of the transistor-condenser chains used and the basic frequency of the square signal. The auxiliary generator 52 shown in FIG. 2 generates the square signal.

In addition the singing suppressor 5 according to the invention operates also in conjunction with electronic delay of different set-ups or constructions, thus e.g. with an analogue delay unit built up of Varicap diodes and inductances, or a delay unit operating on the digital principle. In the former instance the controlling signal controls the capacity of the Varicap diodes directly, whereas in the latter case it controls the clock frequency of analogue-digital and digital-analogue transformers and of dynamic stepping registers through a frequency modulator, and produces in this way a delay time that constantly changes in its temporal order.

Figure 4:
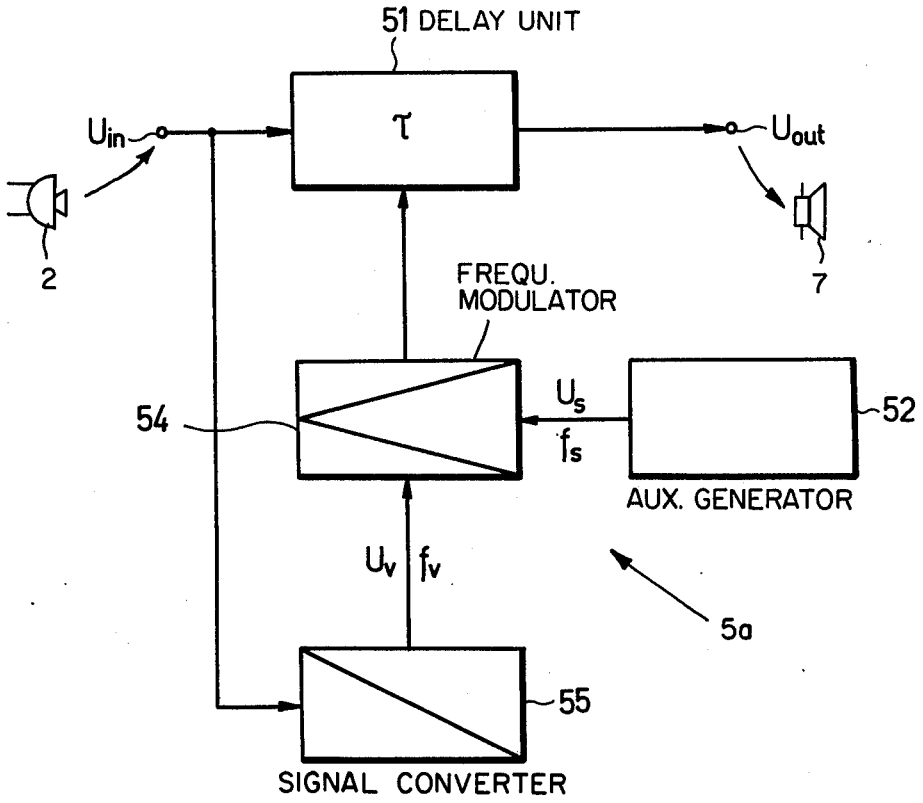
FIG. 4 is a block diagram of another embodiment of the singing suppressor device according to the invention.

In FIG. 4 another possible device 5*a* according to the invention is shown where a signal converting circuit 55, e.g. a rectifier and a low-pass filter is used as the control generator (instead of 53), whose output signal of a voltage $U_v$ and a frequency $f_v$ is gained from the audio frequency signal $U_{in}$ to be boosted by way of transformation. Such a signal converter circuit can e.g. be equipped with a demodulator low-pass filter.

What we claim is:

1. A singing suppressor device (5) for preventing singing and self-oscillation that arises owing to acoustic feedback in an electroacoustic chain (2 to 7) that includes at least one source (1) of audio-frequency signal, at least one sound sensing device (2), at least one amplifier (3, 6) connected to the latter, and at least one sound transducer (7) fed by said amplifier for emitting the audio-frequency signal; the device comprising, in combination, at least one delay unit (51) in said electroacoustic chain between an audio-frequency input ($U_{in}$) and an audio-frequency output ($U_{out}$) of the device, said delay unit having a delay time dependent on the frequency of a signal applied to at least one electrical control input of said delay unit, that determines the delay time; at least one control generator (53) at least indirectly coupled to said control input, for generating an electrical signal that varies in time, and consisting of components of a frequency less than that of the lower limit of the transmitting band of said electroacoustic chain; the coupling between said control generator and said control input of the delay unit being through a serially connected modulator (54); and at least one auxiliary generator (52) coupled to an input of said modulator; wherein at least one of said control generator and of said auxiliary generator is in the form of a signal converter (55) that shapes and transforms the audio-frequency signal, said converter having an input coupled to said source of audio-frequency signal at said audio-frequency input; whereby the singing and the self-oscillation are successfully eliminated in said electroacoustic chain, with the absence of any distortion, dissonance and the like being introduced in the audio-frequency signal.

2. The device as defined in claim 1, wherein said delay unit (51) is of the analog type.

3. The device as defined in claim 1, wherein said delay unit (51) is of the digital type.

4. The device as defined in claim 1, wherein said modulator (51) varies the frequency of the processed electrical signal.

5. The device as defined in claim 1, wherein said control generator (53) produces the electrical signal with a saw-tooth shape.

6. The device as defined in claim 1, wherein the fundamental frequency is less than 20 Hz.

7. The device as defined in claim 1, wherein at least one of said control generator (53) and of said auxiliary generator (52) has an adjustable output signal.

8. The device as defined in claim 7, wherein the frequency of the output signal is adjustable.

* * * * *